US008836630B2

(12) United States Patent
Cheng et al.

(10) Patent No.: US 8,836,630 B2
(45) Date of Patent: Sep. 16, 2014

(54) SOURCE DRIVER AND DISPLAY DEVICE

(71) Applicant: Himax Technologies Limited, Tainan (TW)

(72) Inventors: Jen-Wen Cheng, Tainan (TW); Chuan-Che Lee, Tainan (TW); Chin-Tien Chang, Tainan (TW)

(73) Assignee: Himax Technologies Limited, Tainan (TW)

( * ) Notice: Subject to any disclaimer, the term of this patent is extended or adjusted under 35 U.S.C. 154(b) by 125 days.

(21) Appl. No.: 13/739,930

(22) Filed: Jan. 11, 2013

(65) Prior Publication Data

US 2014/0198086 A1 Jul. 17, 2014

(51) Int. Cl.
*G09G 3/36* (2006.01)

(52) U.S. Cl.
CPC ..... *G09G 3/3614* (2013.01)
USPC ..... 345/98; 345/100

(58) Field of Classification Search
CPC ..... G09G 2310/0286; G09G 2310/0289
USPC ..... 345/98, 100
See application file for complete search history.

(56) References Cited

U.S. PATENT DOCUMENTS

| | | | | |
|---|---|---|---|---|
| 6,909,417 | B2 * | 6/2005 | Washio et al. | 345/98 |
| 7,289,097 | B2 * | 10/2007 | Gyouten et al. | 345/100 |
| 2003/0179174 | A1 * | 9/2003 | Matsuda et al. | 345/100 |

* cited by examiner

*Primary Examiner* — Kevin M Nguyen
(74) *Attorney, Agent, or Firm* — J. C. Patents

(57) ABSTRACT

A source driver including a controller, a plurality of flip-flops, a plurality of shift registers and a plurality of driving channels is provided. The controller extracts control information from an image data stream. Each of the flip-flops respectively receives a corresponding control bit of the control information, and output the corresponding control bit. The shift registers correspond to the flip-flops one by one, and sequentially transmit an enable pulse. Each of the shift registers determines whether to output the enable pulse according to the control bit outputted by the corresponding flip-flop. The driving channels correspond to the shift registers one by one. Each of the driving channels switches an operation state into an enable mode or a disable mode according to the enable pulse outputted by the corresponding shift register.

14 Claims, 5 Drawing Sheets

SOURCE DRIVER AND DISPLAY DEVICE

BACKGROUND OF THE INVENTION

1. Field of the Invention

The invention relates to a source driver and a display device. Particularly, the invention relates to a source driver capable of using control information of an image data stream to adjust an operation state of each driving channel and a display device thereof.

2. Description of Related Art

Along with development of display technology, sizes of display panels are diversified. In order to cope with various display panel specifications, in a general design of a display driving circuit, two sets of pins of a source driver are generally taken as setting pins used for setting a channel number, and a plurality of specifications with different channel numbers are preset to cope with the display panels of different sizes.

However, compatibility of the source drivers designed according to such method is still limited to a certain degree. Moreover, since wiring connected to the setting pins of the source drivers has to be additionally configured to set the source drivers one-by-one, when the source drivers are designed, influence of the wiring has to be further considered. Moreover, in miniaturization design of a driving circuit, the additionally configured wiring may increase difficulty of the circuit design.

SUMMARY OF THE INVENTION

The invention is directed to a source driver, which extracts control information from a received image data stream, and determines whether to allow a corresponding driving channel to access display data according to the control information.

The invention provides a display device, which is capable of adjusting a number of driving channels used in each of source drivers without using setting pins.

The invention provides a source driver including a controller, a plurality of flip-flops, a plurality of shift registers and a plurality of driving channels. The controller extracts control information from an image data stream. The flip-flops are electrically connected to each other in series and receive the control information, wherein each of the flip-flops respectively receives a corresponding control bit of the control information, and output the corresponding control bit. The shift registers are electrically connected to each other in series, and correspond to the flip-flops one by one. The shift registers sequentially transmit an enable pulse, and during a process of transmitting the enable pulse, each of the shift registers determines whether to output the enable pulse according to the control bit output by the corresponding flip-flop. The driving channels correspond to the shift registers one by one. Each of the driving channels switches an operation state to an enable mode or a disable mode according to the enable pulse outputted by the corresponding shift register.

In an embodiment of the invention, the source driver further includes a plurality of level shifters. The level shifters correspond to the flip-flops one-by-one, where each of the level shifters determines whether or not to generate a disable voltage to turn off an output buffer of one of the driving channels according to the control bit output by the corresponding flip-flop.

In an embodiment of the invention, when the enable pulse output by the corresponding shift register is received, the operation state is switched to the enable mode, and when the enable pulse output by the corresponding shift register is not received, the operation state is switched to the disable mode.

In an embodiment of the invention, the controller extracts a plurality of display data from the image data stream, and each of the driving channels accesses the display data in the enable mode, and disables to access the display data in the disable mode.

In an embodiment of the invention, the controller samples a start pulse signal by using a polarity reversal signal and generates a sampling signal, wherein when the sampling signal has a first level, the controller extracts a plurality of display data from the image data stream according to a frame start signal and the start pulse signal, and when the sampling signal has a second level, the controller subsequently extracts the control information from the image data stream according to the start pulse signal.

In an embodiment of the invention, when the sampling signal has the second level, the controller extracts the control information from the blanking region of the image data stream.

The invention provides a display device including a display panel and a plurality of source drivers. The source drivers are configured to drive the display panel, and each of the source drivers includes a controller, a plurality of flip-flops, a plurality of shift registers and a plurality of driving channels. The controller extracts control information from an image data stream. The flip-flops are electrically connected to each other in series and receive the control information, wherein each of the flip-flops respectively receives a corresponding control bit of the control information, and output the corresponding control bit. The shift registers are electrically connected to each other in series, and correspond to the flip-flops one by one. The shift registers sequentially transmit an enable pulse, and during a process of transmitting the enable pulse, each of the shift registers determines whether to output the enable pulse according to the control bit output by the corresponding flip-flop. The driving channels correspond to the shift registers one by one. Each of the driving channels switches an operation state to an enable mode or a disable mode according to the enable pulse outputted by the corresponding shift register.

According to the above descriptions, by using the control information extracted from the image data stream, each driving channel in the source driver determines whether or not to access the display data according to the corresponding control bit. The display device of the invention is unnecessary to set the number of the used driving channels by using the setting pins of the source drivers, which mitigates the influence of wiring of the setting pins on the source drivers, and increases compatibility between a panel driving circuit and the display panel.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
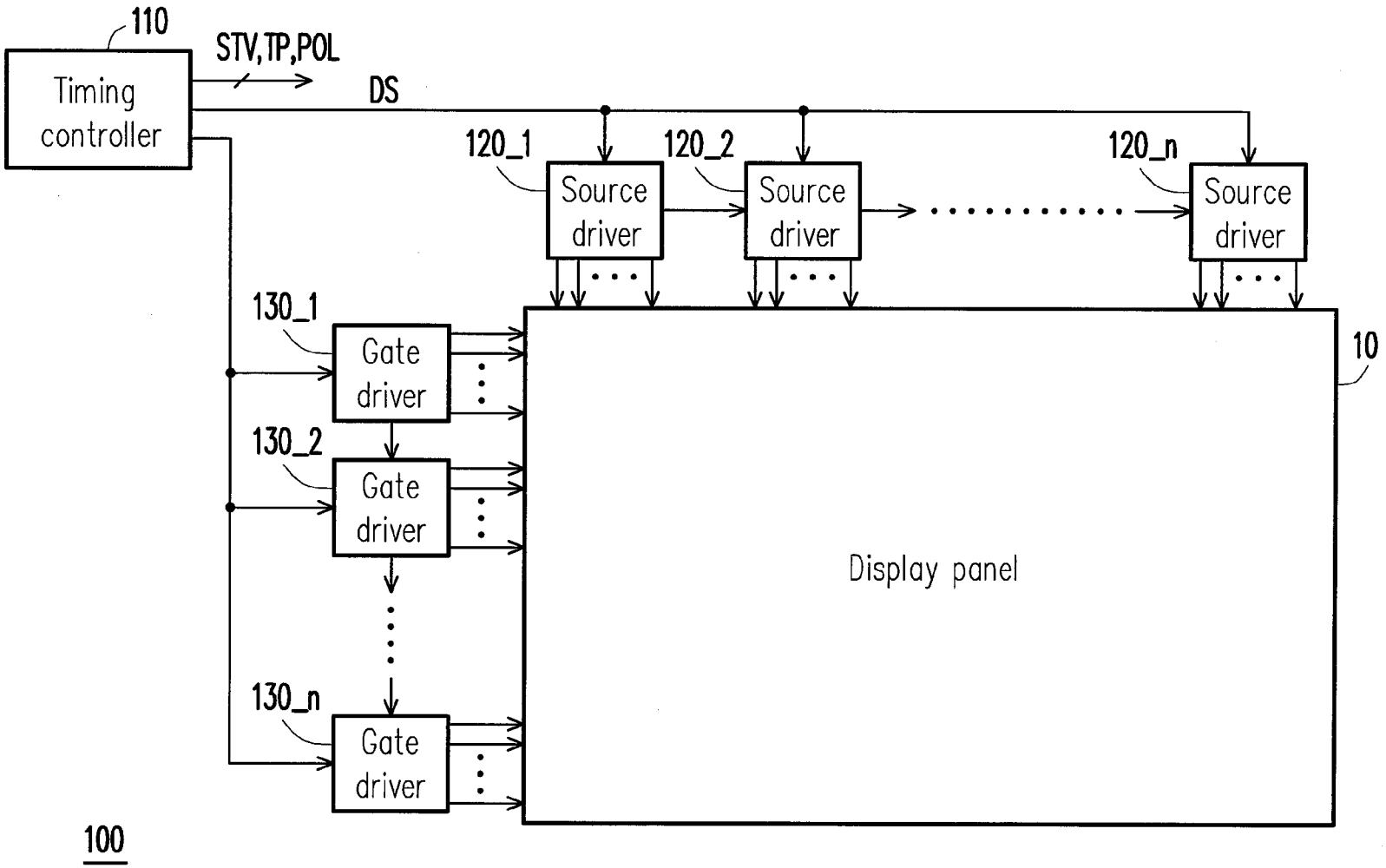
FIG. 1 is a schematic diagram of a display device according to an embodiment of the invention.

A source driver of the invention uses control information extracted from an image data stream to adjust an operation state of each of the driving channels, so that a display device using the aforementioned source driver has high compatibility, which avails an integrated design of modularizing the display device. Moreover, wherever possible, the same reference numbers are used in the drawings and the description to refer to the same or like parts.

FIG. 1 is a schematic diagram of a display device according to an embodiment of the invention. Referring to FIG. 1, the display device 100 includes a timing controller 110, a plurality of source drivers 120_1-120_*n*, a plurality of gate drivers 130_1-130_*m* and a display panel 10. The timing controller 110 generates a plurality of control signals to respectively control operation timings of the source drivers 120_1-120_*n* and the gate drivers 130_1-130_*m*, and outputs an image data stream DS to the source driver 120_1-120_*n*.

The source drivers 120_1-120_*n* are electrically connected to the timing controller 110 and the display panel 10. Moreover, the source drivers 120_1-120_*n* convert display data in the image data stream DS into pixel voltages, and output the pixel voltages to data lines in the display panel 10, so that the display panel 10 can display a corresponding image frame. The gate drivers 130_1-130_*m* are electrically connected to the timing controller 110 and the display panel 10. Moreover, the gate drivers 130_1-130_*m* sequentially output scan signals to scan lines in the display panel 10 according to the corresponding control signal, so as to drive pixels on the scan lines.

In an actual application, the control signals generated by the timing controller 110 includes a frame start signal STV, a start pulse signal TP and a polarity reversal signal POL. The frame start signal STV is a start signal of each image frame. The start pulse signal TP is a latch signal of the display data, and the polarity reversal signal POL is a control signal for controlling polarity reversal of the display panel.

In detail, the source drivers 120_1-120_*n* latches the display data in the image data stream DS according to the start pulse signal TP. For example, the source drivers 120_1-120_*n* sequentially latch serial display data according to a rising edge of the start pulse signal TP, and generate parallel display data according a falling edge of the start pulse signal TP, and convert each of display data into a pixel voltage. Moreover, during a process of converting the display data into the pixel voltages, the source driver 120_1-120_*n* further adjust voltage polarities of the pixel voltages according to the polarity reversal signal POL.

Figure 2:
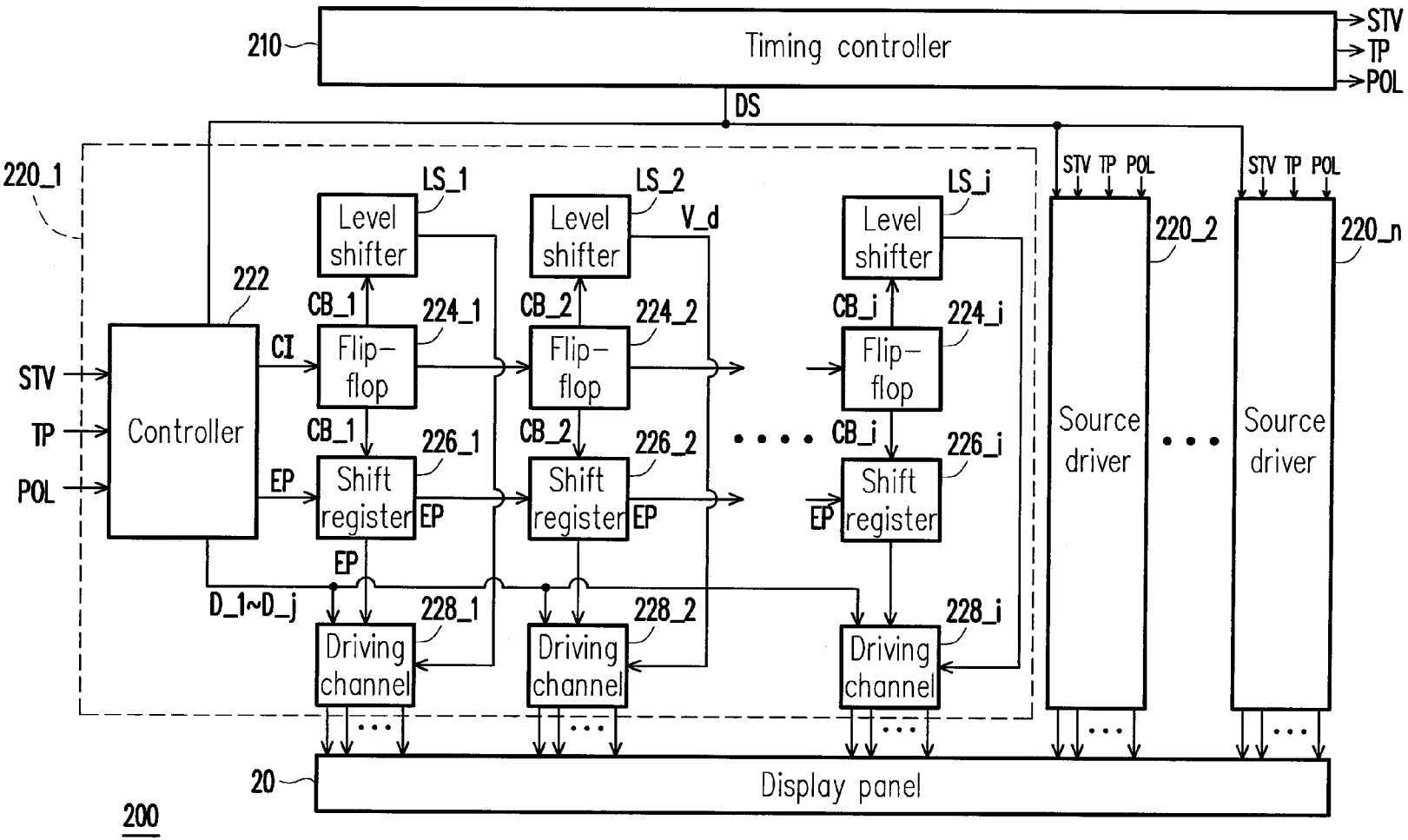
FIG. 2 is a schematic diagram of a display device according to another embodiment of the invention.

The invention is further described below. FIG. 2 is a schematic diagram of a display device according to another embodiment of the invention. Referring to FIG. 2, taking the source driver 220_1 as an example, the source driver 220_1 includes a controller 222, a plurality of flip-flops 224_1-224_*i*, a plurality of shift registers 226_1-226_*i*, a plurality of driving channels 228_1-228_*i* and a plurality of level shifters LS_1-LS_*i*. In an exemplary embodiment, the source driver 220_1, for example, includes 171 driving channels, and each of the driving channels includes 6 output pins. Namely, in the exemplary embodiment, a number of the output pins of the source driver 220_1 is 1026.

The controller 222 extracts control information CI and a plurality of display data D_1-D_*j* from the image data stream DS. The flip-flops 224_1-224_*i* are electrically connected to each other in series. The flip-flops 224_1-224_*i* sequentially transmit a plurality of control bits CB_1-CB_*i* in the control information CI, and output the control bits CB_1-CB_*i* in parallel. For example, if the source driver 220_1 includes 171 driving channels, the control information CI includes 171 control bits, and now the source driver 220_1 correspondingly includes 171 flip-flops and 171 shift registers for controlling the 171 driving channels.

The shift registers 226_1-226_*i* are electrically connected to each other in series, and correspond to the flip-flops 224_1-224_*i* one by one. Moreover, the shift registers 226_1-226_*i* sequentially transmit an enable pulse EP, and during a process of transmitting the enable pulse EP, each of the shift registers 226_1-226_*i* determines whether to output the enable pulse EP according to the control bit output by the corresponding flip-flop. The driving channels 228_1-228_*i* correspond to the shift registers 226_1-226_*i* one by one. Each of the driving channels 228_1-229_*i* switches an operation state to an enable mode or a disable mode according to the enable pulse EP output by the corresponding shift register. In detail, each of the driving channels 228_1-229_*i* detects whether to receive the enable pulse EP output by the corresponding shift register, and switches the operation state to the enable mode or the disable mode according to a detection result, so as to determine whether or not to access display data D_1-D_*j*.

For example, taking the driving channel 228_1 as an example, when the control bit CB_1 output by the flip-flop 224_1 has a logic 1, the shift register 226_1 receives the enable pulse EP from the controller 222, and outputs the enable pulse EP to the driving channel 228_1 according to the control bit CB_1 with the logic 1, and transmits the enable pulse EP to the shift register 226_2 of a next stage. Now, the driving channel 228_1 receives the enable pulse EP, and switches the operation state to the enable mode. Therefore, the driving channel 228_1 is allowed to access the display data D_1-D_*j* to convert the corresponding display data into the pixel voltage, and outputs the pixel voltage to the display panel 10.

On the other hand, taking the driving channel 228_2 as an example, the shift register 226_2 receives the enable pulse EP from the shift register 226_1, and transmits the enable pulse EP to the shift register of a next stage. Moreover, when the control bit CB_2 output by the flip-flop 224_2 has a logic 0, the shift register 226_2 cannot output the enable pulse EP to the driving channel 228_2 according to the control bit CB_2 with the logic 0. In other words, when the control bit CB_2 has the logic 0, the shift register 226_2 only bypasses the enable pulse EP to the shift register of a next stage. Now, the driving channel 228_2 cannot receive the enable pulse EP output by the corresponding shift register 226_2, and switches the operation state to the disable mode. Therefore, the driving channel 228_2 disables accessing of the display data D_1-D_*j*.

In other words, in an actual application, if the source driver 220_1 include 171 driving channels, the source driver 220_1 can control the operation state of each of the driving channels one by one according to the 171 control bits, so that the number of the output pins of the source driver 220_1 complies with a size of the display panel 20. For example, according to the size of the display panel 20, if the driving channel 228_2 of the source driver 120_1 is unnecessary to be used, i.e. the driving channel 228_2 is unnecessary to be electrically connected to the data lines of the display panel 20, the source driver 120_1 can set the driving channel 228_2 to the disable mode through the control bit CB_2.

Moreover, in the present embodiment, taking the source driver 220_1 as an example, the source driver 220_1 further includes level shifters LS_1-LS_*i*. The level shifters LS_1-LS_*i* correspond to the flip-flops 224_1-224_*i* one by one. Moreover, each of the level shifters determines whether or not to generate a disable voltage V_d according to the control bit output by the corresponding flip-flop, so as to turn off an output buffer in the corresponding driving channel.

For example, taking the driving channel 228_1 and the driving channel 228_2 as an example, when the control bit CB_1 output by the flip-flop 224_1 has the logic 1, the level shifter LS_1 does not generate the disable voltage V_d, and the output buffer in the driving channel 228_1 can normally operate. Comparatively, when the control bit CB_2 output by the flip-flop 224_2 has the logic 0, the level shifter LS_2 generates the disable voltage V_d, and the output buffer in the driving channel 228_2 is turned off.

In detail, when the driving channel 228_2 is operated in the disable mode, a latch in the driving channel 228_2 cannot receive the enable pulse EP from the shift register 226_2 and is disabled, and the driving channel 228_2 cannot access the display data D_1-D_*j*. Moreover, to ensure maintaining the driving channel 228_2 to the disable mode, in the present embodiment, the disable voltage V_d output by the level shifter LS_2 is further used to turn off the output buffer of the driving channel 228_2.

As described above, in the present embodiment, the controller 222 of the source driver 220_1 extracts the control information CI and the display data D_1-D_*j* from the image data stream DS. In detail, the controller 222 samples the start pulse signal TP by using the polarity reversal signal POL to generate a sampling signal. In this way, the controller 222 determines the received image data stream includes the display data D_1-D_*j* or the received image data stream is corresponding to a blank region according to the sampling signal. Therefore, the controller 222 transmits the display data D_1-D_*j* to the driving channel 228_1-228_*i*, and extracts the control information CI from the blank region.

Figure 3:
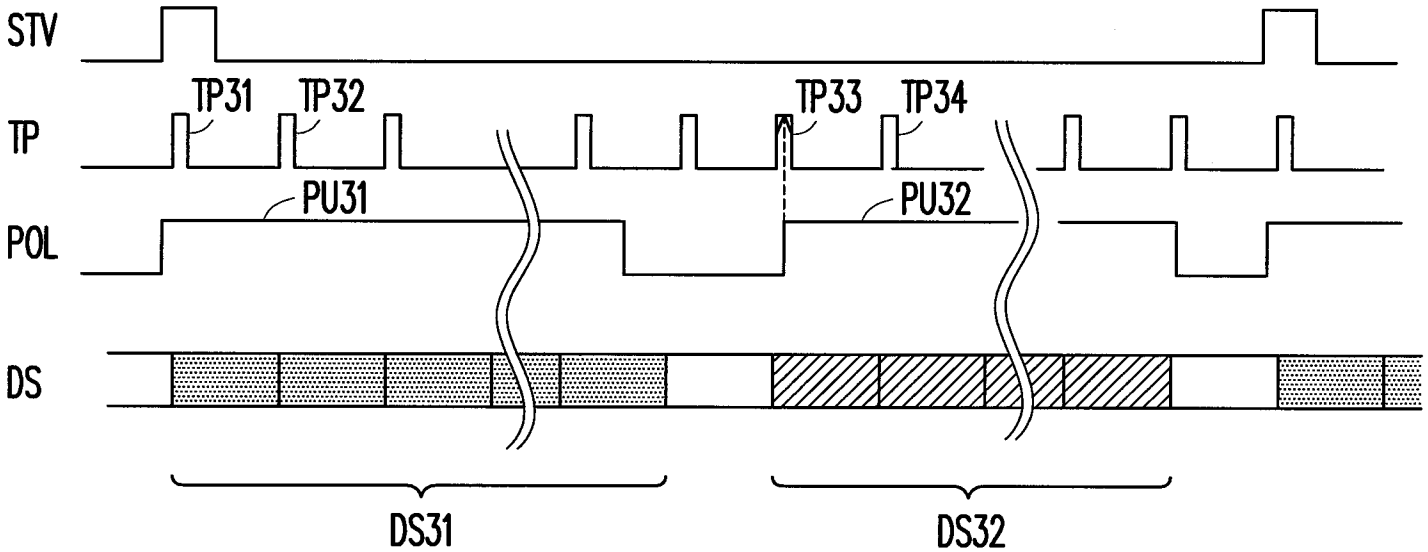
FIG. 3 is a signal timing diagram of a display device according to an embodiment of the invention.

Further, FIG. 3 is a signal timing diagram of the display device according to an embodiment of the invention. Referring to FIG. 2 and FIG. 3, the controller 222 samples the start pulse signal TP according to a rising edge of a pulse PU31 in the polarity reversal signal POL. Now, the start pulse signal TP corresponding to the rising edge of the pulse PU31 has a low level, i.e. the obtained sampling signal has a first level, and the controller 222 determines that a currently transmitted image data stream DS31 is composed of the display data D_1-D_*j*. In other words, when the sampling signal has the first level (for example, the low level), the controller 222 can extract the display data D_1-D _*j* from the image data stream DS31 according to the frame start signal STV and the start pulse signal TP.

Figure 4A:
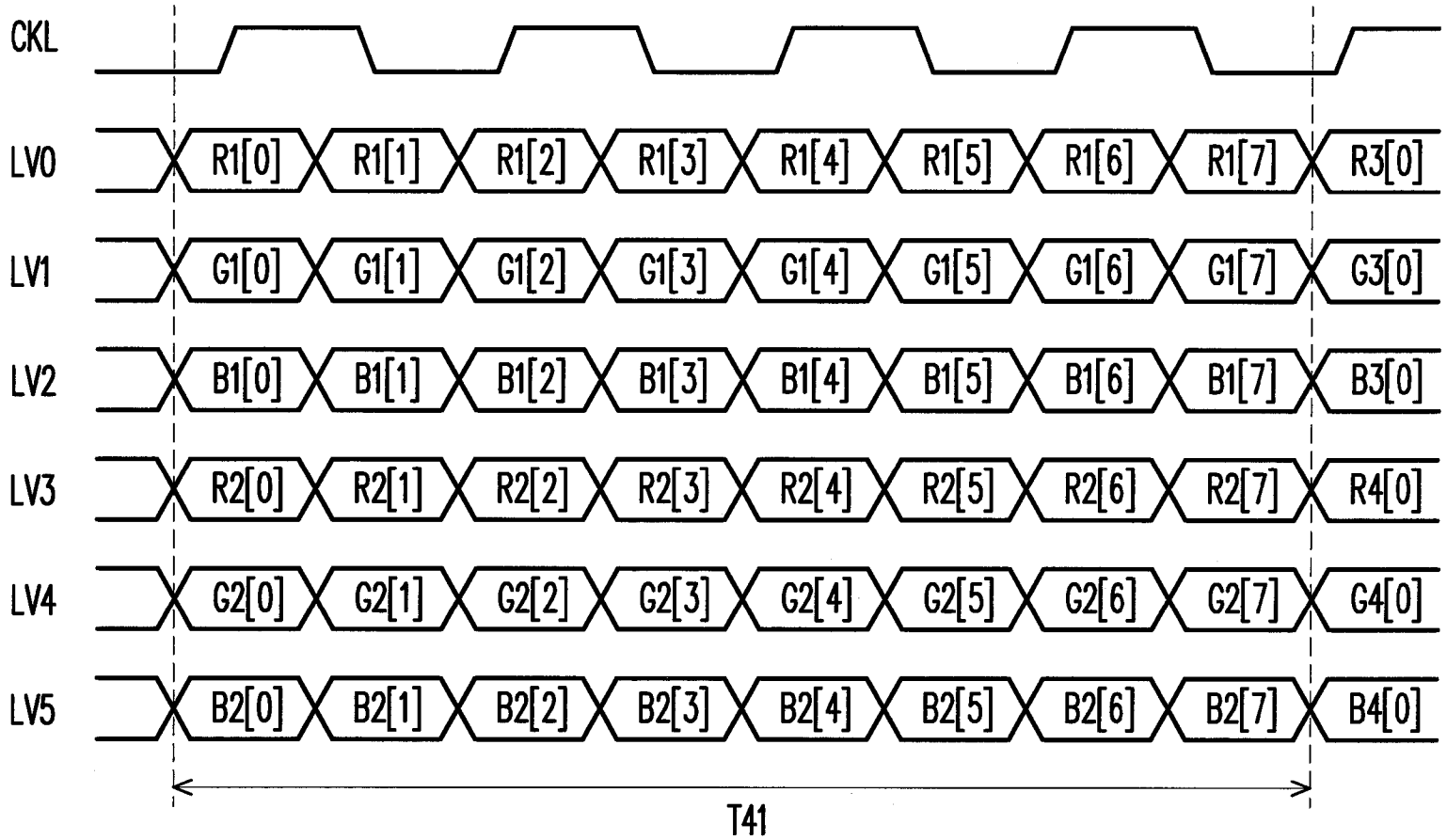
FIG. 4A is a timing diagram of display data according to an embodiment of the invention.

For example, FIG. 4A is a timing diagram of display data according to an embodiment of the invention. Referring to FIG. 4A, in the present embodiment, each of the driving channels includes 6 output pins. Therefore, the timing controller 210 correspondingly generates the image data stream DS composed of 6 data strings LV0-LV5 according to a clock signal CLK. Moreover, in the present embodiment, each of display data includes 8 bits, for example, the display data D_1 is, for example, composed of data bits R1[0]-R1[7], the display data D_2 is, for example, composed of data bits G1[0]-G1[7], and the rest may be deduced by analogy. In other words, as shown in FIG. 4A, in a data period T41, the controller 222 can extract six pieces of display data from the image data stream DS31. Moreover, if the display device 200 includes 6 source drivers, and in each of the source drivers, the number of the driving channels set to the enable mode is 161, between a start pulse TP31 and a start pulse TP32, the timing controller 210 sequentially transmits 6*6*161 pieces of display data through 6*161 data periods.

On the other hand, the controller 222 can also sample the start pulse signal TP according to a rising edge of a pulse PU32 in the polarity reversal signal POL. Now, the start pulse signal TP corresponding to the rising edge of the pulse PU32 has a high level, i.e. the obtained sampling signal has a second level, and the controller 222 determines that a currently transmitted image data stream DS32 is corresponding to the blank region. Moreover, when the sampling signal has the second level, the controller 222 extracts the control information CI from the blank region. In other words, when the sampling signal has the second level, the controller 222 extracts the control information CI from the blank region according to the start pulse signal TP before a next pulse of the polarity reversal signal POL is generated.

Figure 4B:
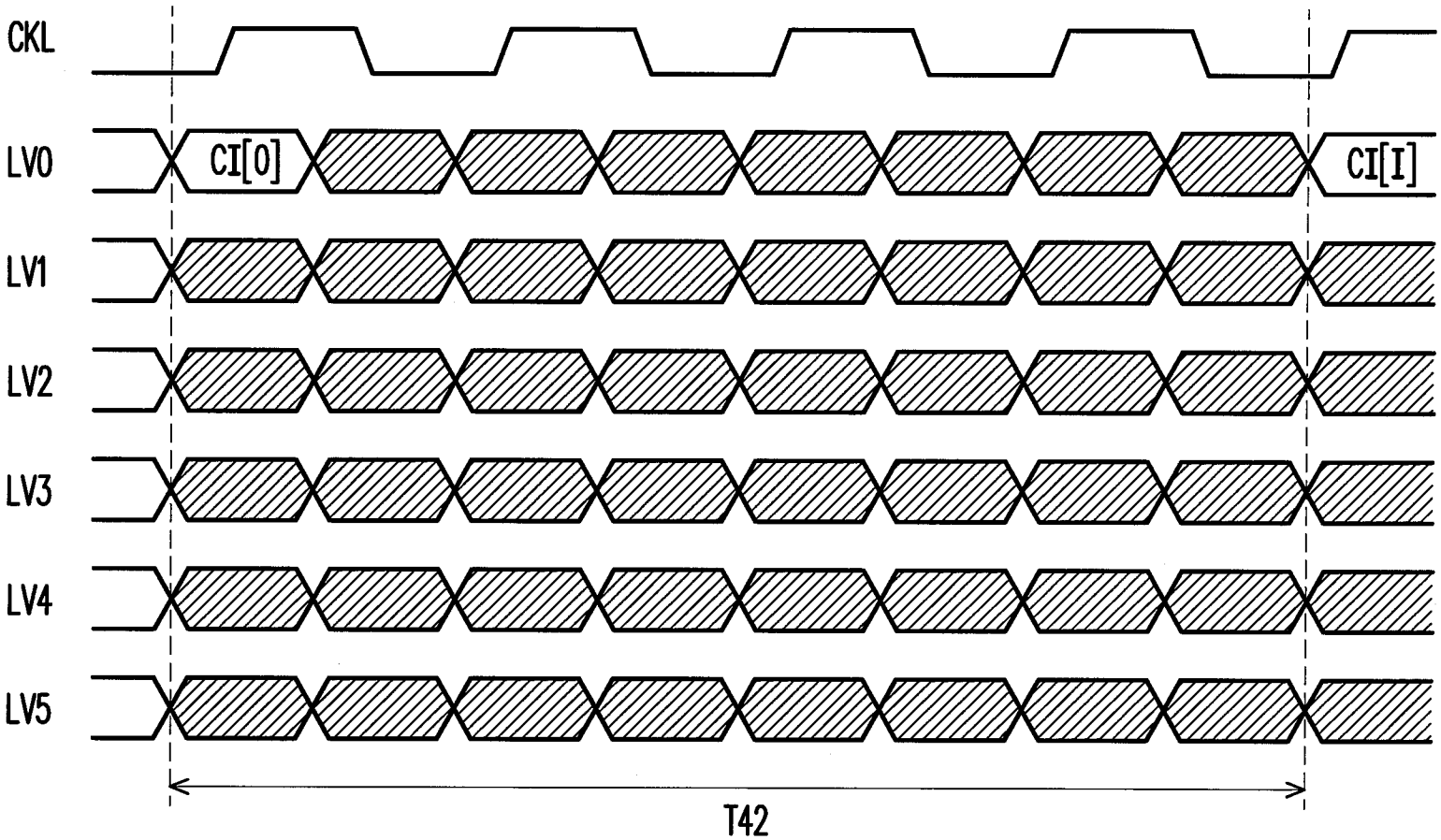
FIG. 4B is a timing diagram of blank region according to an embodiment of the invention.

For example, FIG. 4B is a timing diagram of the blank region according to an embodiment of the invention. Similar to the display data of FIG. 4A, in a data period T42, the blank region of the image data stream is corresponding to 6 pieces of data, and each piece of the data is composed of 8 data bits. Moreover, in each of the data periods, the controller 222 extracts one data bit from the blank region to serve as a control bit in the control information CI. For example, in the data period T42, the controller 222 extracts a data bit CI[0] from blank region to serve as the control bit in the control information CI. In other words, as shown in FIG. 3, if the display device 200 includes 6 source drivers, and each of the source drivers includes 171 driving channels, between a start pulse TP33 and a start pulse TP34, the timing controller 210 sequentially transmits 6 pieces of the control information CI through 6*171 data periods, and each piece of the control information CI includes 171 control bits. As shown in FIG. 4B, in each of the data periods, only a data bit carries the control information CI.

In each of the aforementioned embodiments, the control information in the image data stream is used to respectively control the operation state of each of the driving channels in the source drivers 220_1-220_*n*, so that the number of the used driving channels in the source drivers 220_1-220_*n* can match the size of the display panel 20. In this way, compared to the conventional display device, not only influence of the wiring of the setting pins is mitigated, compatibility between the source drivers 220_1-220_*n* and the display panel 20 is also improved.

In summary, by using the control information extracted from the image data stream, each driving channel in the source driver determines whether or not to access the display data according to the corresponding control bit. Moreover, in the display device of the invention, by adjusting a setting of the timing controller, the timing controller can output dummy data to the corresponding driving channel without varying the source drivers. The display device of the invention is unnecessary to set the number of the used driving channels by using the setting pins of the source drivers, which mitigates the influence of wiring of the setting pins on the source drivers, and increases compatibility between the source drivers and the display panel.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A source driver, comprising:

a controller, extracting control information from an image data stream;

a plurality of flip-flops, electrically connected to each other in series, receiving the control information, wherein each of the flip-flops respectively receives a corresponding control bit of the control information, and output the corresponding control bit;

a plurality of shift registers, electrically connected to each other in series, and corresponding to the flip-flops one by one, wherein the shift registers sequentially transmit an enable pulse, and during a process of transmitting the enable pulse, each of the shift registers determines whether to output the enable pulse according to the control bit output by the corresponding flip-flop; and a plurality of driving channels, corresponding to the shift registers one by one, wherein each of the driving channels switches an operation state to an enable mode or a disable mode according to the enable pulse outputted by the corresponding shift register.

2. The source driver as claimed in claim 1, further comprising:

a plurality of level shifters, corresponding to the flip-flops, wherein each of the level shifters determines whether to generate a disable voltage to turn off an output buffer of one of the driving channels according to the control bit output by the corresponding flip-flop.

3. The source driver as claimed in claim 1, wherein when the enable pulse output by the corresponding shift register is received, the operation state is switched to the enable mode, and when the enable pulse output by the corresponding shift register is not received, the operation state is switched to the disable mode.

4. The source driver as claimed in claim 1, wherein the controller extracts a plurality of display data from the image data stream, and each of the driving channels accesses the plurality of display data in the enable mode, and disables to access the plurality of display data in the disable mode.

5. The source driver as claimed in claim 1, wherein the controller samples a start pulse signal by using a polarity reversal signal and accordingly generates a sampling signal, wherein when the sampling signal has a first level, the controller extracts a plurality of display data from the image data stream according to a frame start signal and the start pulse signal, and when the sampling signal has a second level, the controller subsequently extracts the control information from the image data stream according to the start pulse signal.

6. The source driver as claimed in claim 5, wherein when the sampling signal has the second level, the controller extracts the control information from the blanking region of the image data stream.

7. The source driver as claimed in claim 5, wherein the frame start signal, the start pulse signal and the polarity reversal signal are generated by a timing controller.

8. A display device, comprising:

a display panel; and a plurality of source drivers, driving the display panel, and each of the source drivers comprising:

a controller, extracting control information from an image data stream;

a plurality of flip-flops, electrically connected to each other in series, receiving the control information, wherein each of the flip-flops respectively receives a corresponding control bit of the control information, and output the corresponding control bit;

a plurality of shift registers, electrically connected to each other in series, and corresponding to the flip-flops one by one, wherein the shift registers sequentially transmit an enable pulse, and during a process of transmitting the enable pulse, each of the shift registers determines whether to output the enable pulse according to the control bit output by the corresponding flip-flop; and a plurality of driving channels, correspond to the shift registers one by one, wherein each of the driving channels switches an operation state to an enable mode or a disable mode according to the enable pulse outputted by the corresponding shift register.

9. The display device as claimed in claim 8, wherein each of the source drivers further comprises:

a plurality of level shifters, corresponding to the flip-flops, wherein each of the level shifters determines whether to generate a disable voltage to turn off an output buffer of one of the driving channels according to the control bit output by the corresponding flip-flop.

10. The display device as claimed in claim 8, wherein when the enable pulse output by the corresponding shift register is received, the operation state is switched to the enable mode, and when the enable pulse output by the corresponding shift register is not received, the operation state is switched to the disable mode.

11. The display device as claimed in claim 8, wherein the controller extracts a plurality of display data from the image data stream, and each of the driving channels accesses the plurality of display data in the enable mode, and disables to access the plurality of display data in the disable mode.

12. The display device as claimed in claim 8, wherein the controller samples a start pulse signal by using a polarity reversal signal and accordingly generates a sampling signal, wherein when the sampling signal has a first level, the controller extracts a plurality of display data from the image data stream according to a frame start signal and the start pulse signal, and when the sampling signal has a second level, the controller subsequently extracts the control information from the image data stream according to the start pulse signal.

13. The display device as claimed in claim 12, wherein when the sampling signal has the second level, the controller extracts the control information from the blanking region of the image data stream.

14. The display device as claimed in claim 12, further comprising:

a time controller, generating the frame start signal, the start pulse signal and the polarity reversal signal.

* * * * *